United States Patent [19]

Lemarinel et al.

[11] 3,992,270

[45] Nov. 16, 1976

[54] METHOD OF RECLAIMING NICKEL VALUES FROM A NICKELIFEROUS ALLOY

[75] Inventors: Robert Lemarinel, Elancourt; Jean-Michel Demarthe, Viroflay; Louis Gandon, Rambouillet, all of France

[73] Assignee: Imetal, Paris, France

[22] Filed: Jan. 29, 1975

[21] Appl. No.: 545,223

[30] Foreign Application Priority Data

Feb. 5, 1974 France ..... 74.03750

[52] U.S. Cl. ..... 204/113; 75/101 R; 75/101 BE; 75/119; 423/141; 423/150; 423/493

[51] Int. Cl.[2] ..... C25C 5/00; C22B 23/04; C25C 1/08

[58] Field of Search ..... 75/101 R, 119; 423/141, 423/150, 493; 204/113

[56] References Cited

UNITED STATES PATENTS

| | | | |
|---|---|---|---|
| 3,656,937 | 4/1972 | Gandon et al. | 75/101 R |
| 3,656,940 | 4/1972 | Gandon et al. | 75/119 |
| 3,660,020 | 5/1972 | Gandon et al. | 75/119 X |
| 3,660,026 | 5/1972 | Michel et al. | 75/113 X |
| 3,839,168 | 11/1974 | Gandon et al. | 204/113 |
| 3,840,446 | 10/1974 | Gandon et al. | 204/113 |
| 3,871,978 | 3/1975 | Gandon et al. | 204/113 |
| 3,884,681 | 5/1975 | Gandon | 423/493 |

*Primary Examiner*—G. Ozaki
*Attorney, Agent, or Firm*—Fleit & Jacobson

[57] ABSTRACT

A method and apparatus for reclaiming nickel values from a nickeliferous alloy in which the nickeliferous alloy is subjected to nitric lixiviation and the nickel values are recovered from the resulting nickel nitrate solution.

16 Claims, 2 Drawing Figures

METHOD OF RECLAIMING NICKEL VALUES FROM A NICKELIFEROUS ALLOY

Figure 1:
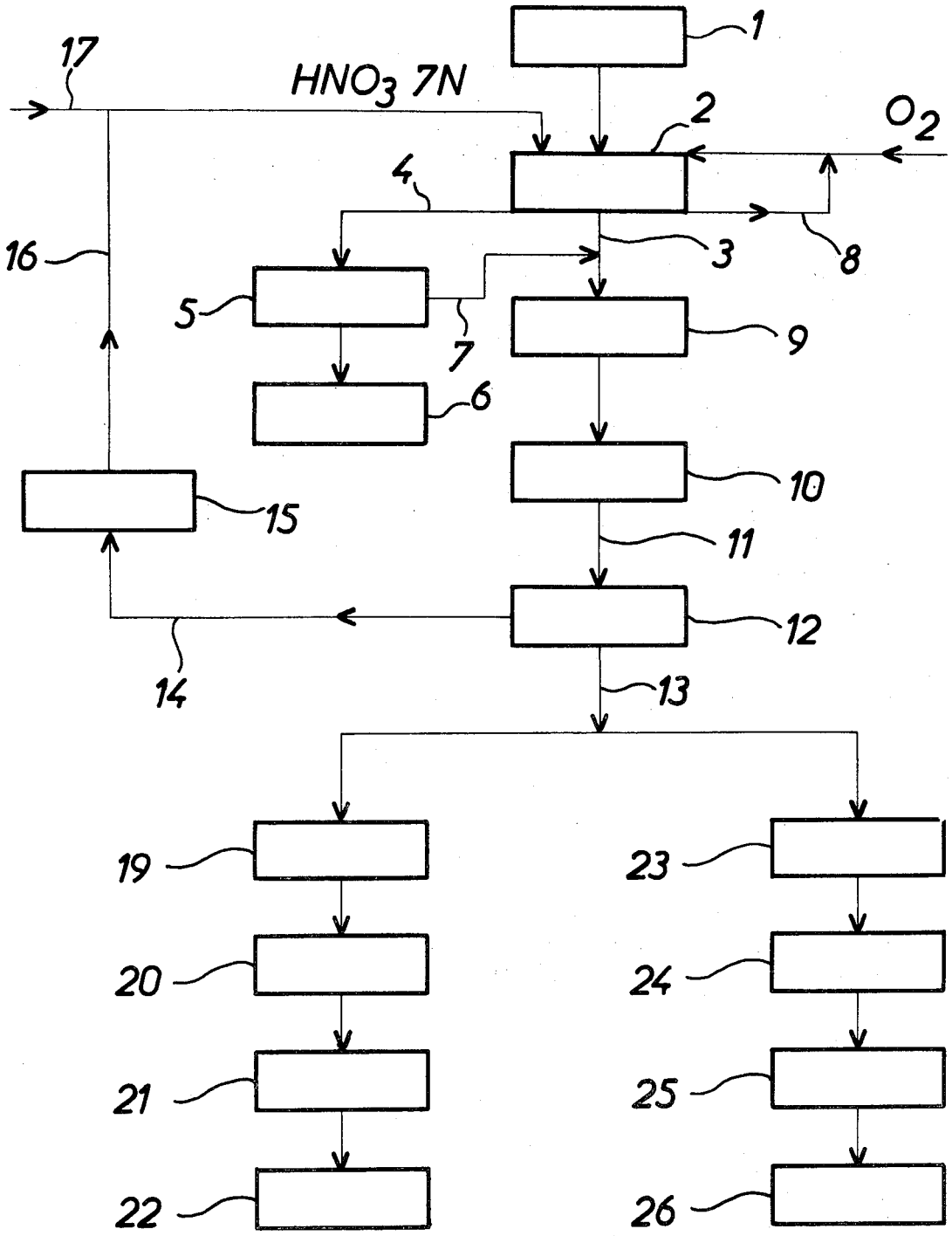

This invention relates to a method of reclaiming nickel values from nickeliferous alloys, such as ferro-nickel and nickeliferous stainless steel scrap, and extends to nickel values, including nickel, reclaimed by the method. By "nickel values" are meant various purifiable forms of nickel, such as nickel nitrate hexahydrate crystals, nickel chloride, nickel oxide, and hard nickel, which can be further purified to yield a high-purity nickel as the ultimate value.

There are various known methods of reclaiming nickel values in oxide, metallic or salt form from ferro-nickel, which is obtained by smelting oxidised nickel ores. In addition to pyrometallurgical methods of refining, there is also a single hydrometallurgical method which is at present almost ready for use on an industrial scale.

The last-mentioned method comprises an oxidising sulphuric lixiviation of ferro-nickel in the presence of a copper catalyst, and the elimination of iron in the form of jarosite. This method, however, is complicated, since special operating conditions are required for the formation of jarosite, and has the disadvantage of yielding a nickel sulphate solution which is suitable only for electrolysis and which, more particularly, cannot easily be made to yield nickel oxide, a product which is highly valued by iron and steel metallurgists. The method has the further disadvantage that it is applicable only to ferro-nickel with a high nickel content, e.g. of the order of 85 to 90%.

We have carried out research on developing a hydrometallurgical method which does not have the disadvantages of the aforementioned method.

An object of the invention, therefore, is to provide a method of reclaiming nickel values from a nickeliferous alloy with a wider permissible range of iron and nickel contents, which method does not require elaborate crushing of the starting material.

The invention also relates to a method of the aforementioned kind which, from the first step onwards, can be used to eliminate the iron in an environmentally acceptable form, and to eliminate certain impurities such as chromium, aluminium and silica. Another object of the invention is to reclaim a nickel salt which can easily be converted into an oxide or a metal.

The method of reclaiming nickel values from a nickeliferous alloy, such as ferro-nickel, according to the invention, comprises subjecting the nickeliferous alloy to nitric lixiviation and recovering nickel values from the resulting nickel nitrate solution.

According to the invention, nitric lixiviation of the nickeliferous alloy is advantageously performed at a temperature between 80° and 100° C, using nitric acid preferably in aqueous solution and having a normality between 1N and 14N, preferably between 5N and 10N. The lixiviation process is more efficient if the nickeliferous alloy is in granulated form, the granules having an average size of the order of a millimetre.

Preferably, the nitric lixiviation is performed in the presence of oxygen, usually either from the air or injected into the reactor.

Advantageously, in order to improve the economics of the method, the nitrous vapours formed during lixiviation can be recovered and subsequently converted into nitric acid, which can be used for lixiviating fresh quantities of the nickeliferous alloy.

Lixiviation according to the invention can be used to obtain a concentrated nickel nitrate solution containing more than 100 g/l of nickel, with excellent yields of at least 99.6%. In the solution, the proportion Fe/Ni is less than 1/100 and thus confirms the selectivity of lixiviation according to the invention, which is such that iron can be separated from nickel in a single process step.

During the lixiviation operation, the iron usually undergoes a first, temporary conversion into ferrous nitrate, a compound which is rapidly converted into goethite [FeO(OH)], which is precipitated. If lixiviation is performed in the presence of oxygen, the iron may, however, be directly converted into goethite.

An advantage of the method according to the invention is that the precipitation of iron in the form of goethite is accompanied by the evolution of nitrous vapours in accordance with the equation:

$$(1)\ 3Fe(NO_3)_2 + 4\,H_2O \rightarrow 3\,FeO(OH) + 5\,NHO_3 + NO\uparrow$$

These nitrous vapours can be recombined into nitric acid in a suitable installation, in accordance with the reaction:

$$(2)\ 4\,NO + 3\,O_2 + 2H_2O \rightarrow 4\,HNO_3$$

so that negligible nitric acid is consumed in processing the iron.

Nickel from the nickeliferous alloy is dissolved (as the nitrate) by the nitric acid in accordance with the reaction:

$$(3)\ 3\,Ni + 8\,HNO_3 \rightarrow {}_{3Ni(NO_3)_2} + 2NO\uparrow + 4H_2O$$

and the resulting nitrous vapours are recycled.

Consequently the actual consumption of nitric acid during the lixiviation operation corresponds, apart from losses, solely to the conversion into nickel nitrate of the nickel in the starting ferro-nickel. This clearly has an advantageous effect on the economics of the method.

The resulting goethite precipitate can easily be separated, suitably by filtration or decanting, from the nickel nitrate solution. Moreover, goethite is the easiest form of iron oxide to use commercially.

According to the invention, nickel in the nickel nitrate solution is recovered.

The recovery advantageously comprises a first purification step for eliminating metallic impurities from the solution. This purification step is simplified since nitric lixiviation of, for example, ferro-nickel yields a nickel nitrate solution which is already free from certain impurities, mainly chromium, aluminium and silica.

The nickel nitrate solution can be purified by any known method, e.g. by liquid-liquid exchange using an organic phase containing a sulphonium thiocyanate, in accordance with the method described in British Pat. No. 1,314,924 in respect of a method of separating valuable metallic substances in aqueous solution, and products for working the method. The solution may alternatively be purified by treatment with a cationic solvent such as an alkyl phosphoric acid and/or by removal of cobalt by using a basic nickel (III) carbonate, according to the method described in U.S. Pat. Nos. 3,890,243 and 3,903,246.

Subsequently, the resulting purified solution is either directly pyrohydrolysed or subjected to crystallisation of nickel nitrate hexahydrate [$Ni(NO_3)_2.6H_2O$], which is then pyrolysed by known methods. Both methods yield, firstly, nickel oxide having a purity which, of course, depends on the degree to which the nickel nitrate solution has been purified and, secondly, nitrous vapours which, in order to improve the economics of the method, may advantageously be recovered in order to synthesize nitric acid, which can be used for lixiviating fresh quantities of ferro-nickel, so that the actual overall consumption of nitric acid is reduced to a minimum.

The resulting nickel oxide can be sintered and sold as such, or can be processed to obtain pure nickel.

Accordingly, in one embodiment of the method according to the invention, nickel oxide is subjected to a conventional reducing treatment to obtain relatively hard nickel, which is converted into pure nickel by electro-refining, using soluble anodes.

In a second embodiment of the method according to the invention, nickel oxide is dissolved in hydrochloric acid to obtain a nickel chloride solution which is subsequently purified by any known method and electrolysed to obtain highly-pure nickel. The nickel chloride solution can be purified, e.g., by the method described in U.S. Pat. No. 3,839,168 in respect of a method of producing high-purity nickel from nickeliferous mattes.

Suitable apparatus for performing the method according to the invention comprises an upright reactor of which a lower portion has a smaller diameter than an upper portion, an axial tube extending into the upper portion and terminating at the lower portion, a generally horizontal grid in said lower portion, two ducts debouching below the grid, a settling tank, an overflow duct between the settling tank and the upper portion of the reactor, a recycling duct externally connecting the top of the reactor to one of the debouching ducts, an overflow provided with a drain between the settling tank and the recycling duct, an oxygen inlet duct terminating in the recycling duct, and a turbine in the recycling duct downstream of the oxygen inlet duct, the second debouching duct being connectable to a supply of nitric acid.

Figure 2:
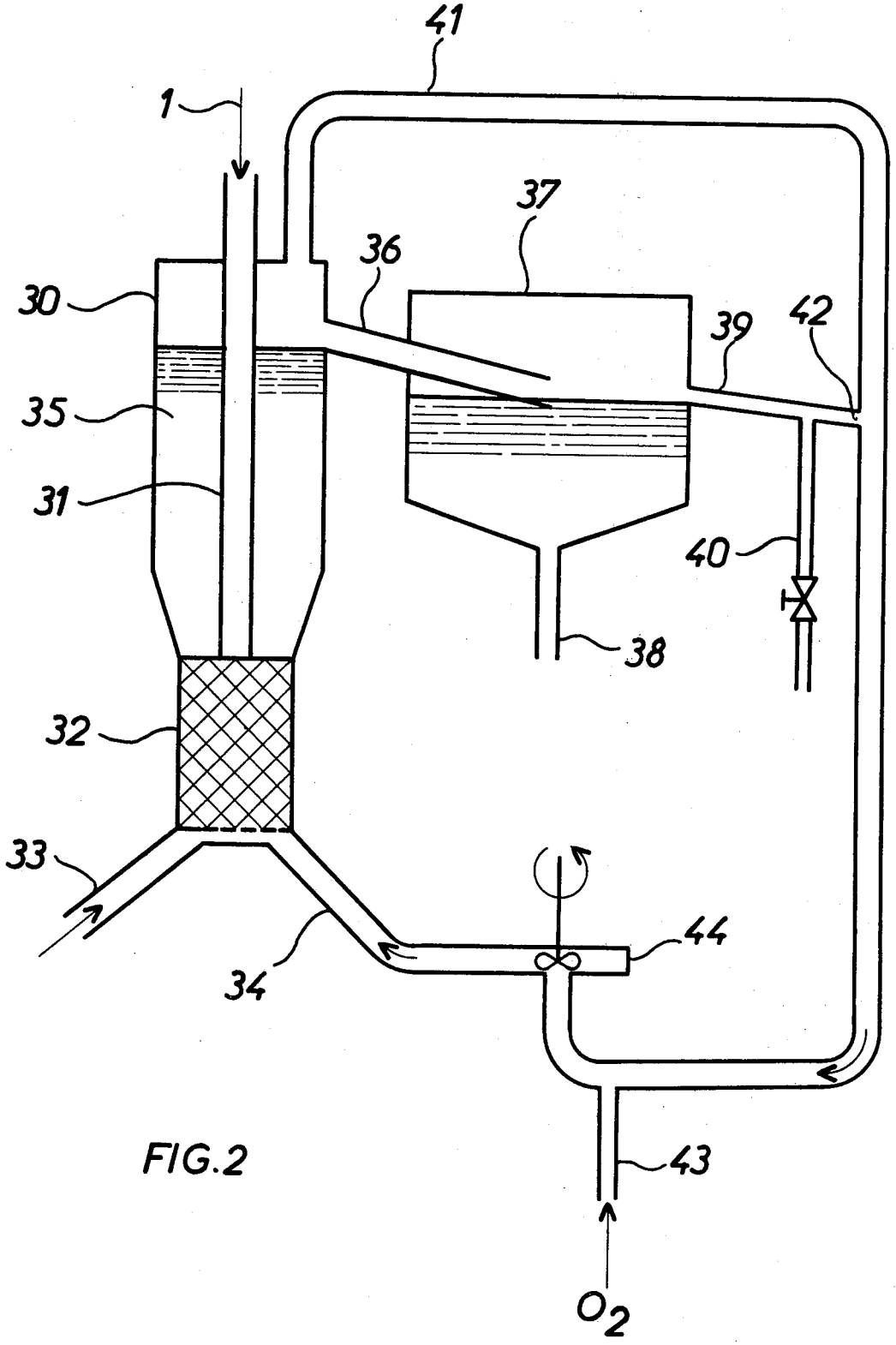

The method according to the invention will now be described, purely by way of example, with reference to the accompanying drawings, in which:

FIG. 1 is a diagrammatic representation of the various steps of the method according to the invention, and FIG. 2 is a diagrammatic representation of apparatus used for nitric lixiviation in the method according to the invention.

As shown in FIG. 1, ferro-nickel 1 granulated to a particle size of approximately 1 mm is lixiviated at 2 by 7N nitric acid, yielding a nickel nitrate solution 3 and a precipitate 4 which is decanted at 5, yielding goethite 6 and nickel nitrate solution 7 which is added to the solution 3.

Nitrous vapours 8 evolved during the lixiviation 2 are immediately recycled to the lixiviation reactor at 2 after adding oxygen or air.

The nickel nitrate solution 3 is partially purified at 9, using cationic solvents, and is then freed from cobalt at 10, using basic nickel (III) carbonate.

The resulting purified solution 11 is pyrolysed at 12, yielding nickel oxide 13 and nitrous oxygen 14. The nitrous vapours 14 are converted at 15 into nitric acid 16 which, together with fresh nitric acid 17, is introduced into the lixiviation reactor at 2.

In a first embodiment, shown on the left-hand side of the drawing, nickel oxide 13 is reduced at 19 to nickel 20 which, in the form of cakes, can be purified by electro-refining at 21, yielding pure nickel 22.

In a second embodiment, shown on the right-hand side of the drawing, nickel oxide 13 is dissolved at 23 in hydrochloric acid and the resulting solution is additionally purified at 24 over ion-exchange resins and then electrolysed at 25, yielding pure nickel 26. In the latter case, of course, there is no need for purification in a nitric medium.

Nitric lixiviation according to the invention may advantageously be performed in the apparatus shown in FIG. 2.

The apparatus comprises a vertical reactor 30 having two cylindrical parts interconnected by a frusto-conical portion, the bottom part 32 having a smaller diameter. An axial tube 31 extends into the top part 35 of the reactor and terminates in the bottom part 32, the base of which is provided with a horizontal grind having inlets underneath into which ducts 33 and 34 debouch, the duct 33 supplying nitric acid and the duct 34 recycling nitrous vapours. The top part 35 of the reactor is provided, at some distance from its top, with an overflow duct 36 which terminates in a settling tank 37, the bottom of which leads into a duct 38 for discharging the settled material. The top part of the tank 37 is provided with an overflow duct 39 at or slightly below the outlet end of the overflow duct 36. The duct 39 is likewise inclined slightly downwards and is provided with a drain 40 having a valve. The duct 39 terminates at a junction 42 in a duct 41 for recycling the nitrous vapours from the reactor 30. The duct 41 extends from the top of the reactor 40 and is provided, beyond the junction 42, with a bleeding-in duct 43 for supplying oxygen. The duct 41 leads to the duct 34 for recycling the nitrous vapours, a turbine being disposed where the two meet.

Advantageously, the aforementioned apparatus operates as follows:

Ferro-nickel is introduced into the reactor 30, which is kept at a temperature of 95°–100° C, via the axial tube 31 leading to the bottom part 32 of the reactor, which forms the reaction region.

The reactor is also supplied via the duct 33 with 7N nitric acid and via the duct 34 with a mixture of nitric acid and nickel nitrate, the origin of which will be described hereinafter. The materials are injected in a manner which is regulated so that the resulting geothite is suspended in the mixture of nitric acid and nickel nitrate, thus improving the contact between the reagents and the efficiency of the operation.

Any ferro-nickel entrained by the flow of solutions injected at 33 and 34 is separated from the geothite in the top part 35 (or "clarifying" part) of the reactor. The ratio between the diameter of the part 36 and the flow rate of input materials is adjusted so that the ferro-nickel falls back into the reaction region 32, whereas the geothite, still suspended in the liquid, is entrained thereby towards the overflow duct 36 terminating in the settling tank 37.

The material settling in the tank 37 may contain at least 50% by weight of solids, and is discharged through the duct 38 over a filter (not shown) on which the geothite cake is washed.

The overflow from the tank 37, which escapes via the overflow duct 39 and essentially comprises nickel nitrate in solution, is mainly recovered through the drain 40, in order to purify the nickel nitrate solution. A smaller proportion of the solution flows past the junction 42 into the recycling duct 41, which conveys the nitrous vapours formed in the reactor 30 and which also has an opening for the oxygen supply bleeding-in duct 43.

The nickel nitrate, together with the nitrous vapours and oxygen, is agitated by the turbine 44, where nitric acid is synthesised. The mixture of nitric acid and nickel nitrate leaving the turbine then debouches into the reactor via the duct 34.

This apparatus is very suitable for continuous operation of the lixiviation method according to the invention, using a continuous supply of ferro-nickel at 1 and of nitric acid at 33 and 34, mixed with a small quantity of nickel nitrate.

The following specific and non-limitative example relates to the nitric lixiviation of ferro-nickel 25 in the presence of oxygen.

Operation is continous in the aforementioned apparatus, using 7N nitric acid at a flow rate of 250 ml/h, 85 g/h of ferro-nickel being introduced into the reactor and having the following composition:

| | |
|---|---|
| Ni | 27.67 % |
| Co | 0.59 % |
| Fe | 71.01 % |

The reactor is maintained at a temperature of 95°–98° C and oxygen is injected therein at 120 1/h.

The operation is continued for 24 hours under the same conditions, yielding a pH 4 solution having the following average composition:

| | |
|---|---|
| Ni | 138 g/l |
| Co | 3.0 g/l |
| Cu | 0.05 g/l |
| Fe | 0.38 g/l |
| Cr | 97 mg/l |

The residue after lixiviation, when washed, has the following composition:

| | |
|---|---|
| Ni | 0.08 % |
| Fe | 56.0 % |
| $NO_3$ | 2.24 % |

These results correspond to a nickel solubilisation yield of 99.6%. The lixiviation solution contains less than 0.3% iron with respect to nickel (Fe/Ni = 0.28%).

What we claim is:

1. A method of reclaiming nickel values from a nickeliferous alloy consisting essentially of nickel and iron and minor amounts of other metals, comprising subjecting the nickeliferous alloy to nitric acid lixiviation and recovering nickel values from the resulting nickel nitrate solution.

2. A method as claimed in claim 1, wherein the lixiviation is performed at a temperature from 80 to 100° C using nitric acid having a normality from 1N to 14N.

3. A method as claimed in claim 2, wherein the normality of the nitric acid is from 5N to 10N.

4. A method as claimed in claim 1, wherein the nickeliferous alloy is in granulated form, the granules having an average size of the order of a millimeter.

5. A method as claimed in claim 1, wherein the nitric lixiviation is performed in the presence of oxygen.

6. A method as claimed in claim 1, wherein the nitrous vapours formed during the lixiviation are recovered and subsequently converted into nitric acid.

7. A method as claimed in claim 1, wherein the recovery of nickel values from the nickel nitrate solution comprises partially purifying the nickel nitrate solution by means of a cationic solvent, freeing the resulting partially purified solution from cobalt by means of basic nickel carbonate, and pyrohydrolyzing the thus-purified solution to produce nickel oxide.

8. A method as claimed in claim 1, wherein the recovery of nickel values from the nickel nitrate solution comprises partially purifying the nickel nitrate solution by means of a cationic solvent, freeing the resulting partially purified solution from cobalt by means of basic nickel carbonate, crystallizing the formed nickel nitrate hexahydrate, and pyrolyzing the thus-formed nickel nitrate hexahydrate crystals to produce nickel oxide.

9. A method of reclaiming pure nickel from a nickeliferous alloy in a granular form comprising lixiviating the alloy with nitric acid having a normality ranging about from 1N to 14N, at a temperature of about from 80° to 100° C, in the presence of oxygen, to obtain a nickel nitrate solution, partially purifying the nickel nitrate solution by means of a cationic solvent, freeing the resulting partially purified solution from cobalt by means of basic nickel carbonate, pyrohydrolyzing the thus-purified solution to produce nickel oxide, and converting the nickel oxide into pure nickel.

10. The method of claim 9 wherein the conversion of the nickel oxide into pure nickel is carried out by reducing the nickel oxide to hard nickel and converting the hard nickel into pure nickel by electro-refining.

11. The method of claim 9 wherein the conversion of the nickel oxide into pure nickel is carried out by dissolving the nickel oxide in hydrochloric acid to obtain a nickel chloride solution, additionally purifying the nickel chloride solution over ion-exchange resins, and electrolyzing the resulting pure nickel chloride solution to obtain pure nickel.

12. The method of claim 9 wherein the granules have an average size on the order of a millimeter and the nickeliferous alloy contains approximately 27.67% of nickel, 71.01% of iron, and 0.59% of cobalt.

13. A method of reclaiming pure nickel from a nickeliferous alloy in a granular form comprising lixiviating the alloy with nitric acid having a normality ranging about from 1N to 14N, at a temperature of about from 80° to 100° C, in the presence of oxygen, to obtain a nickel nitrate solution, partially purifying the nickel nitrate solution by means of a cationic solvent, freeing the resulting partially purified solution from cobalt by means of basic nickel carbonate, crystallizing the formed nickel nitrate hexahydrate, pyrolyzing the thus-formed nickel nitrate hexahydrate crystals to produce nickel oxide, and converting the nickel oxide into pure nickel.

14. The method of claim 13 wherein the conversion of the nickel oxide into pure nickel is carried out by reducing the nickel oxide to hard nickel and converting the hard nickel into pure nickel by electro-refining.

15. The method of claim 13 wherein the conversion of the nickel oxide into pure nickel is carried out by dissolving the nickel oxide in hydrochloric acid to obtain a nickel chloride solution, additionally purifying the nickel chloride solution over ion-exchange resins, and electrolyzing the resulting pure nickel chloride solution to obtain pure nickel.

16. The method of claim 13 wherein the granules have an average size on the order of a millimeter and the nickeliferous alloy contains approximately 27.67% of nickel, 71.01% of iron, and 0.59% of cobalt.

* * * * *